US012146499B2

(12) United States Patent
Tanaka et al.

(10) Patent No.: US 12,146,499 B2
(45) Date of Patent: Nov. 19, 2024

(54) COMPRESSION SYSTEM, CHEMICAL PLANT, AND METHOD OF OPERATING COMPRESSION SYSTEM

(71) Applicant: MITSUBISHI HEAVY INDUSTRIES COMPRESSOR CORPORATION, Tokyo (JP)

(72) Inventors: Yuya Tanaka, Hiroshima (JP); Daisuke Kiuchi, Hiroshima (JP); Kunio Hamano, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 161 days.

(21) Appl. No.: 18/154,270

(22) Filed: Jan. 13, 2023

(65) Prior Publication Data

US 2023/0228274 A1 Jul. 20, 2023

(30) Foreign Application Priority Data

Jan. 17, 2022 (JP) ..... 2022-005147

(51) Int. Cl.
*F04D 27/00* (2006.01)
*F04D 17/12* (2006.01)

(52) U.S. Cl.
CPC ..... *F04D 27/007* (2013.01); *F04D 17/12* (2013.01); *F04D 27/008* (2013.01)

(58) Field of Classification Search
CPC ..... F04D 17/12; F04D 27/007; F04D 27/008
See application file for complete search history.

(56) References Cited

FOREIGN PATENT DOCUMENTS

JP 2009-085047 A 4/2009

*Primary Examiner* — Connor J Tremarche
(74) *Attorney, Agent, or Firm* — Osha Bergman Watanabe & Burton LLP

(57) ABSTRACT

A compression system includes a compressor that compresses a synthesis gas to produce a compressed gas, a first line that supplies a first gas constituting the synthesis gas to the compressor, a second line that supplies a second gas constituting the synthesis gas to the first line, a discharge line that circulates the compressed gas, a recirculation line that recirculates a part of the compressed gas from the discharge line to the first line, a first regulating valve arranged in the first line, a second regulating valve arranged in the second line, a discharge valve arranged in the discharge line, a recirculation valve arranged in the recirculation line, and a valve control device that performs switching between the first regulating valve, the second regulating valve, the discharge valve, and the recirculation valve based on an operation condition of the compressor.

6 Claims, 5 Drawing Sheets

| | FIRST REGULATING VALVE | SECOND REGULATING VALVE | DISCHARGE VALVE | RECIRCULATION VALVE |
|---|---|---|---|---|
| VALVE STATE DURING RATED OPERATION | OPEN | OPEN | OPEN | CLOSE |
| FIRST VALVE STATE | CLOSE | OPEN | OPEN | OPEN |
| SECOND VALVE STATE | CLOSE | CLOSE | CLOSE | OPEN |
| THIRD VALVE STATE | CLOSE | OPEN | OPEN OR CLOSE | OPEN |
| FOURTH VALVE STATE | OPEN | OPEN | OPEN | CLOSE |

COMPRESSION SYSTEM, CHEMICAL PLANT, AND METHOD OF OPERATING COMPRESSION SYSTEM

BACKGROUND OF THE INVENTION

Field of the Invention

The present disclosure relates to a compression system, a chemical plant, and a method of operating a compression system.

Priority is claimed on Japanese Patent Application No. 2022-5147, filed on Jan. 17, 2022, the content of which is incorporated herein by reference.

Description of Related Art

For example, Patent Document 1 discloses a compression device for compressing process gas such as LNG in a chemical plant and a control method thereof.

CITATION LIST

Patent Document

[Patent Document 1] Japanese Unexamined Patent Application, First Publication No. 2009-85047

SUMMARY OF THE INVENTION

By the way, a compression device may be stopped urgently due to occurrence of some kind of abnormality during operation. In this case, rotation of a rotor of the compression device may stop while process gas is sealed in the compression device. When the compression device is restarted in this state, a torque required to rotate the rotor of the compression device may be greater than a torque required to start the compression device.

The present disclosure provides a compression system, a chemical plant, and a method of operating a compression system that can reduce the torque required to restart the compressor.

According to an aspect of the present disclosure, there is provided a compression system including: a constant speed motor; a compressor that is configured to rotate by the constant speed motor to compress a synthesis gas including at least a first gas and a second gas to produce a compressed gas; a first line that connected to the compressor to supply the first gas constituting a part of the synthesis gas to the compressor; a second line that is connected to the first line to supply the second gas constituting a part of the synthesis gas to the first line; a discharge line that is connected to the compressor to circulate the compressed gas discharged from the compressor; a recirculation line that connects the discharge line and the first line to recirculate a part of the compressed gas from the discharge line to the first line; a first regulating valve configured to adjust a flow rate of the first gas in the first line; a second regulating valve configured to adjust a flow rate of the second gas in the second line; a discharge valve configured to adjust a flow rate of the compressed gas in the discharge line; a recirculation valve configured to adjust a flow rate of the compressed gas in the recirculation line; and a valve control device configured to perform switching between the first regulating valve, the second regulating valve, the discharge valve, and the recirculation valve based on an operation condition of the compressor, in which the valve control device includes a determination unit that determines whether or not the compressor is abnormal, a motor control unit that stops an operation of the constant speed motor when the determination unit determines that the compressor is abnormal, and a switching processing unit configured to switch a fluid circulation state in the first regulating valve, the second regulating valve, the discharge valve, and the recirculation valve between a fully open state that allows circulation and a fully closed state that prevents circulation when the operation of the constant speed motor is stopped, the first gas has a first molecular weight, the second gas has a second molecular weight smaller than the first molecular weight, the switching processing unit switches the first regulating valve, the second regulating valve, the discharge valve, and the recirculation valve from a valve state during a rated operation of the compressor to a first valve state when the operation of the constant speed motor is stopped, and in the first valve state, the first regulating valve is switched from the fully open state, which is the valve state during the rated operation, to the fully closed state, the second regulating valve and the discharge valve are maintained in the fully open state, which is the valve state during the rated operation, and the recirculation valve is switched from the fully closed state, which is the valve state during the rated operation, to the fully open state.

According to another aspect of the present disclosure, there is provided a chemical plant including: the compression system; a first gas supply source that produces the first gas and supplies the first gas to the first line; and a second gas supply source that produces the second gas and supplies the second gas to the second line.

According to still another aspect of the present disclosure, there is provided a method of operating a compression system including a constant speed motor, a compressor that is configured to rotate by the constant speed motor to compress a synthesis gas including at least a first gas and a second gas to produce a compressed gas, a first line that connected to the compressor to supply the first gas constituting a part of the synthesis gas to the compressor, a second line that is connected to the first line to supply the second gas constituting a part of the synthesis gas to the first line, a discharge line that is connected to the compressor to circulate the compressed gas discharged from the compressor, a recirculation line that connects the discharge line and the first line to recirculate a part of the compressed gas from the discharge line to the first line, a first regulating valve configured to adjust a flow rate of the first gas in the first line, a second regulating valve configured to adjust a flow rate of the second gas in the second line, a discharge valve configured to adjust a flow rate of the compressed gas in the discharge line, and a recirculation valve configured to adjust a flow rate of the compressed gas in the recirculation line, the method including: an abnormality determination step of determining whether or not the compressor is abnormal; a motor control step of stopping an operation of the constant speed motor when it is determined that the compressor is abnormal; and a switching processing step of switching a fluid circulation state in the first regulating valve, the second regulating valve, the discharge valve, and the recirculation valve between a fully open state that allows circulation and a fully closed state that prevents circulation when the operation of the constant speed motor is stopped, in which the first gas has a first molecular weight, the second gas has a second molecular weight smaller than the first molecular weight, in the switching processing step, when the operation of the constant speed motor is stopped, the first regulating valve, the second regulating valve, the discharge valve, and the recirculation valve are switched from a valve state during a rated operation of the compressor to a first valve state, in the first valve state, the first regulating valve is switched from the fully open state, which is the valve state during the rated operation, to the fully closed state, the second regulating valve and the discharge valve are maintained in the fully open state, which is the valve state during the rated operation, and the recirculation valve is switched from the fully closed state, which is the valve state during the rated operation, to the fully open state.

According to the present disclosure, the torque required to restart the compressor can be reduced.

DETAILED DESCRIPTION OF THE INVENTION

Hereinafter, a compression system, a chemical plant, and a method of operating a compression system according to embodiments of the present disclosure will be described based on the drawings.

Chemical Plant

Figure 1:
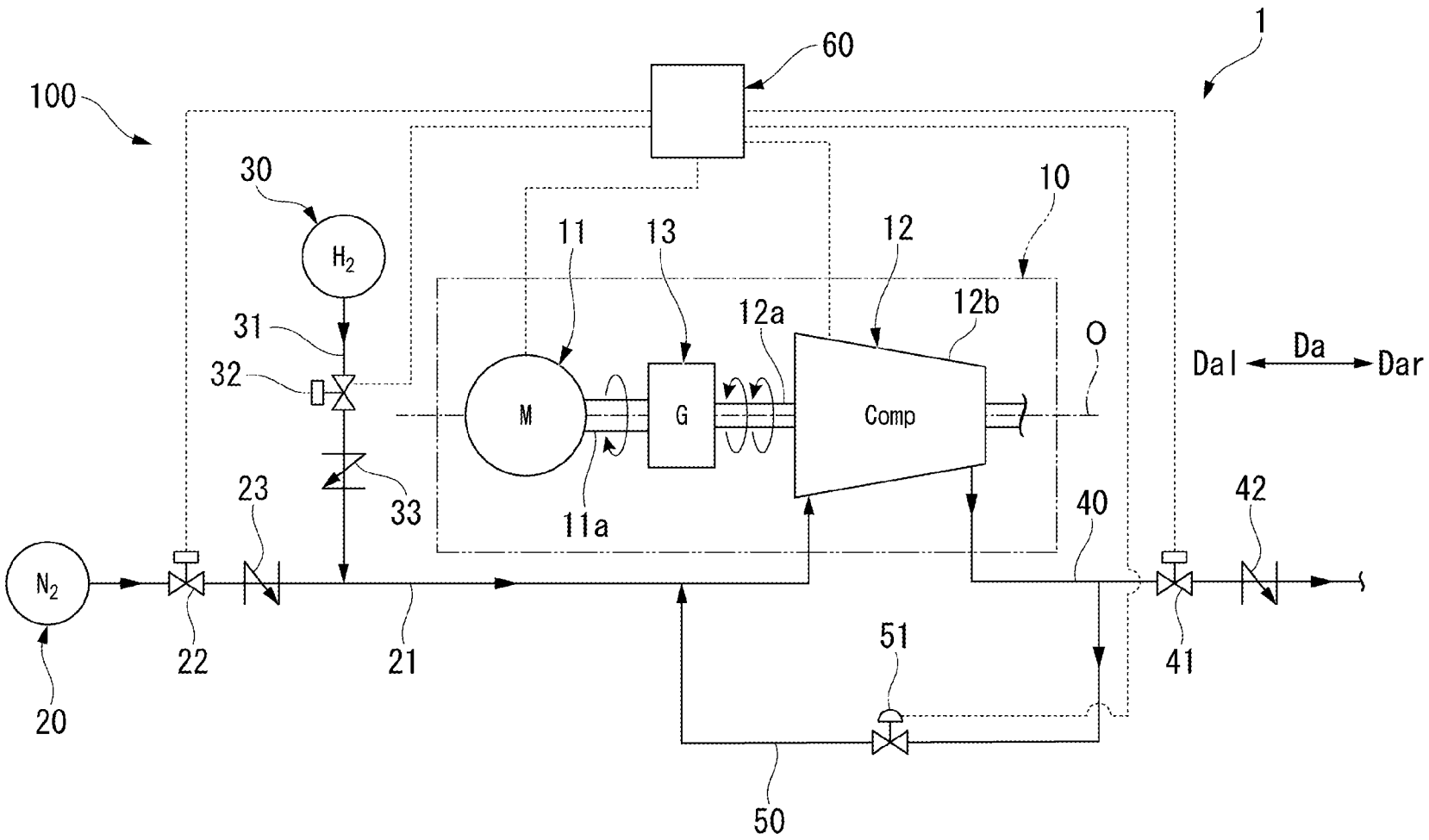
FIG. 1 is a diagram showing a configuration of a compression system according to an embodiment of the present disclosure.

The chemical plant is a green ammonia plant that produces ammonia. As shown in FIG. 1, a chemical plant 100 includes a compression system 1, a first gas supply source 20, and a second gas supply source 30.

Compression System

The compression system 1 compresses a process gas (synthesis gas) as a working fluid generated in the chemical plant 100, for example, and supplies the pressurized synthesis gas to a reaction device (not shown) such as a reactor included in the chemical plant 100.

The compression system 1 includes a compression device 10, a first regulating valve 22, a first check valve 23, a second regulating valve 32, a second check valve 33, a discharge valve 41, a third check valve 42, a recirculation line 50, a recirculation valve 51, a valve control device 60, a first line 21, a second line 31, and a discharge line 40.

Compression Device

The compression device 10 compresses externally supplied synthesis gas for use within the chemical plant 100. The compression device 10 supplies the compressed synthesis gas to the reaction device. The compression device 10 has a constant speed motor 11, a compressor 12, and a speed increaser 13. The synthesis gas in the present embodiment is generated by synthesizing different gases including at least a first gas and a second gas.

Constant Speed Motor

The constant speed motor 11 is a drive source for the compressor 12 that generates power for driving the compressor 12 and rotates the compressor 12. The constant speed motor 11 is applied with a voltage from the outside and rotates at a constant speed (fixed speed). The constant speed motor 11 has, for example, a motor stator as a stator and a motor rotor as a rotator having an output shaft 11*a*.

The motor stator is electrically connected to a current supply source (not shown) located outside the constant speed motor 11. When current flows through coils included in the motor stator, an electromagnetic force is generated that rotates the motor rotor. Therefore, when electric power is input from the outside to the motor stator of the constant speed motor 11, the output shaft 11*a* of the motor rotor rotates.

The output shaft 11*a* is a drive shaft rotatable around an axis O extending in a horizontal direction. Hereinafter, a direction in which this axis O extends is simply referred to as "axial direction Da". Further, one side (right side in FIG. 1) in the axial direction Da is simply referred to as "one side Dar", and the other side (left side in FIG. 1) is simply referred to as the "other side Dal".

Compressor

The compressor 12 is a rotary machine that is rotated by the constant speed motor 11 to compress the synthesis gas and generate compressed gas that has been raised to a predetermined pressure value. The compressor 12 is arranged on one side Dar of the constant speed motor 11. The compressor 12 has a compressor casing 12*b* and a compressor rotor 12*a* (rotor).

The compressor casing 12*b* is a member forming an outer shell of the compressor 12. The compressor casing 12*b* is supported by a compressor support portion (not shown) fixed to the ground, a frame, or the like, and circulates synthesis gas therein. The compressor casing 12*b* has an inlet (not shown) for sucking the synthesis gas and an outlet (not shown) for discharging compressed gas.

The compressor rotor 12*a* has a rotating shaft and a multi-stage impeller (not shown). The multi-stage impeller is fixed to the rotating shaft and forms a compression flow path for compressing the synthesis gas together with the inner surface of the compressor casing 12*b*.

The rotating shaft is rotatable around the axis O, like the output shaft 11*a* of the constant speed motor 11. The rotating shaft is rotatably fixed to the compressor casing 12*b* via, for example, a bearing device, a seal device, or the like.

The multi-stage impeller is housed in the compressor casing 12*b*. The impellers are arranged on the rotating shaft so as to be aligned in the axial direction Da, and rotate around the axis O integrally with the rotating shaft.

A flow of the synthesis gas introduced into the compressor 12 is described below. One end of the first line 21 extending from the compression device 10 to the outside is connected to the inlet of the compressor casing 12*b* of the compressor 12. Through this first line 21, the synthesis gas is supplied from the outside to the inside of the compressor casing 12*b*.

The synthesis gas introduced into the compressor casing 12*b* through the inlet is sequentially compressed by the multi-stage impeller of the compressor rotor 12*a* rotating at high speed inside the compressor casing 12*b*. The synthesis gas, which has been increased to a predetermined pressure value by a final stage impeller and turned into the compressed gas, is discharged to the outside of the compression device 10 through the outlet of the compressor casing 12*b*.

One end of a discharge line 40 for discharging the compressed gas is connected to the outlet. Through this discharge line 40, the compressed gas inside the compressor casing 12*b* is supplied to the reaction device outside the compression device 10.

In the present embodiment, the compressor 12 and the constant speed motor 11 are connected via the speed increaser 13. The speed increaser 13 is a variable speed increaser that increases a rotation speed of the rotating shaft of the compressor rotor 12*a* to be higher than a rotation speed of the output shaft 11*a* of the motor rotor in the constant speed motor 11.

Specifically, an end portion of the one side Dar in the output shaft 11*a* of the motor rotor and an end portion of the other side Dal in the rotating shaft of the compressor rotor 12*a* are each connected to gears of the speed increaser 13. It should be noted that a rotation direction of the compressor rotor 12*a* of the compressor 12 around the axis O is opposite to a rotation direction of the output shaft 11*a* of the motor 11 around the axis O with the speed increaser 13 as a boundary.

Here, the first gas supply source 20 and the second gas supply source 30 provided in the chemical plant 100 will be described.

First Gas Supply Source

The first gas supply source 20 is a device that produces a first gas having a first molecular weight and supplies the produced first gas to the compressor 12 of the compression device 10. The first gas supply source 20 in the present embodiment is, for example, an air separation unit that separates only nitrogen ($N_2$) from air using differences in freezing points. The first gas supply source 20 supplies nitrogen separated from air to the compressor 12 in the compression device 10 as the first gas.

Here, the first gas supply source 20 and the compressor 12 of the compression device 10 are connected by the first line 21. That is, the one end of the first line 21 is connected to the inlet of the compressor 12 and the other end of the first line 21 is connected to the first gas supply source 20. Therefore, the first gas produced by the first gas supply source 20 is supplied to the compressor 12 through this first line 21.

Second Gas Supply Source

The second gas supply source 30 is a device that produces a second gas having a second molecular weight smaller than the first molecular weight and supplies the produced second gas into the first line 21. The second gas supply source 30 in the present embodiment is, for example, a device that separates only hydrogen ($H_2$) from water by electrolyzing water ($H_2O$). The second gas supply source 30 supplies hydrogen separated from water into the first line 21 as the second gas.

Here, the second gas supply source 30 and the first line 21 are connected by the second line 31. One end of the second line 31 is connected to the second gas supply source 30 and the other end of the second line 31 is connected to the middle of the first line 21. Therefore, the second gas generated by the second gas supply source 30 is supplied to the first line 21 through this second line 31.

Therefore, the synthesis gas is generated by joining the first gas and the second gas in the first line 21. That is, the first gas and the second gas each constitute a part of the synthesis gas. Therefore, in the present embodiment, the synthesis gas is not pre-stored, but is produced by mixing the first gas and the second gas in the first line 21 immediately before the compression device 10.

First Regulating Valve

The first regulating valve 22 is arranged in the middle of the first line 21. The first regulating valve 22 is a valve that can adjust a flow rate of the first gas flowing through the first line 21. The first regulating valve 22 in the present embodiment is an on/off valve that can be switched between a fully open state and a fully closed state. The fully open state is a state in which the first gas in the first line 21 can circulate toward the compressor 12. The fully closed state is a state in which the first gas in the first line 21 cannot circulate toward the compressor 12. The first regulating valve 22 is arranged in the first line 21 closer to the first gas supply source 20 side than a connection position the first line 21 with the second line 31.

First Check Valve

The first check valve 23 is arranged in the middle of the first line 21. The first check valve 23 is a valve that prevents the first gas from flowing reversely in the first line 21 from the compressor 12 toward the first gas supply source 20 side. The first check valve 23 is arranged in the first line 21 between a connection position of the first line 21 with the second line 31 and the first regulating valve 22.

Second Regulating Valve

The second regulating valve 32 is arranged in the middle of the second line 31. The second regulating valve 32 is a valve that can adjust a flow rate of the second gas flowing through the second line 31. The second regulating valve 32 in the present embodiment is an on/off valve that can be switched between a fully open state and a fully closed state. The fully open state is a state in which the second gas in the second line 31 can circulate toward the first line 21. The fully closed state is a state in which the second gas in the second line 31 cannot circulate toward the first line 21.

Second Check Valve

The second check valve 33 is arranged in the middle of the second line 31. The second check valve 33 is a valve that prevents the second gas from flowing reversely through the first line 21 from the compressor 12 toward the second gas supply source 30 side in the second line 31. The second check valve 33 is arranged in the second line 31 closer to the first line 21 side than the second regulating valve 32 in the second line 31.

Discharge Valve

The discharge valve 41 is arranged in the middle of the discharge line 40. The discharge valve 41 is a valve that can adjust a flow rate of the compressed gas flowing through the discharge line 40. The discharge valve 41 in the present embodiment is an on/off valve that can be switched between a fully open state and a fully closed state. The fully open state is a state in which the compressed gas in the discharge line 40 can circulate toward the reaction device. The fully closed state is a state in which the compressed gas in the discharge line 40 cannot circulate toward the reaction device.

Third Check Valve

The third check valve 42 is arranged in the middle of the discharge line 40. The third check valve 42 is a valve that prevents the compressed gas from flowing reversely in the discharge line 40 toward the compressor 12. The third check valve 42 in the present embodiment is arranged in the discharge line 40 along with the compressor 12 so as to sandwich the discharge valve 41 therebetween on the discharge line 40.

Recirculation Line

The recirculation line 50 is arranged so as to extend over the discharge line 40 and the first line 21. The recirculation line 50 is an anti-surge line capable of recirculating the compressed gas flowing through the discharge line 40 into the first line 21. That is, the recirculation line 50 joins the compressed gas discharged from the compressor 12 with the synthesis gas introduced into the compressor 12.

One end of the recirculation line 50 is connected to the discharge line 40 closer to the compressor 12 side than the discharge valve 41 in the discharge line 40. The other end of the recirculation line 50 is connected to the first line 21 closer to the compressor 12 side than a connection position of the first line 21 with the second line 31.

Recirculation Valve

A recirculation valve 51 is arranged in the recirculation line 50. The recirculation valve 51 in the present embodiment is a flow rate regulating valve (anti-surge valve) that can adjust the flow rate of the compressed gas flowing through the recirculation line 50 toward the first line 21.

Valve Control Device

Figures 2, 3:
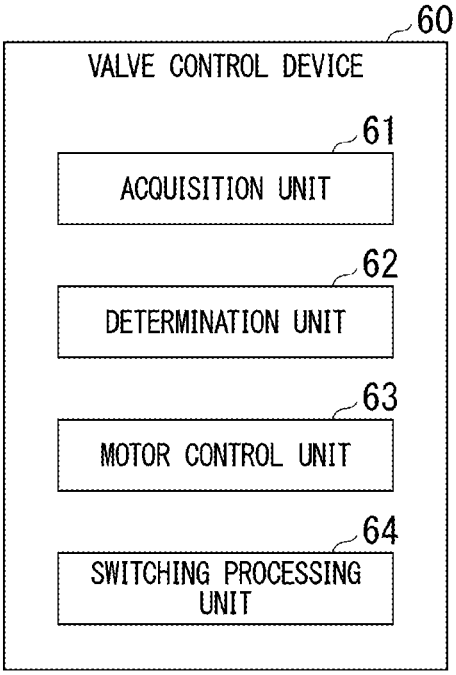
FIG. 2 is a functional block diagram showing a configuration of a valve control device according to the embodiment of the present disclosure.
FIG. 3 is a functional block diagram showing the configuration of the valve control device according to the embodiment of the present disclosure.

The valve control device 60 is a device capable of switching between the first regulating valve 22, the second regulating valve 32, the discharge valve 41, and the recirculation valve 51 based on an operation condition of the compressor 12. As shown in FIG. 2, the valve control device 60 has an acquisition unit 61, a determination unit 62, a motor control unit 63, and a switching processing unit 64.

Acquisition Unit

The acquisition unit 61 acquires state data of the compressor 12 at predetermined time intervals. The state data of the compressor 12 in the present embodiment can include, for example, the rotation speed of the compressor rotor 12*a* calculated based on a measurement result of a sensor provided in the compressor 12, a temperature of an atmosphere in the compression flow path measured by a sensor arranged in the compressor 12, a temperature of a bearing device measured by a sensor included in the bearing device supporting the rotating shaft of the compressor 12, and the like.

Here, the rotation speed of the compressor rotor 12*a* is calculated based on a magnitude of an applied voltage obtained by measuring a voltage applied to the constant speed motor 11 by the sensor and a gear ratio of the speed increaser 13, for example.

Therefore, the acquisition unit 61 acquires the state data of the compressor 12 from the various sensors described above through signal lines or the like. The acquisition unit 61 transmits the acquired state data to the determination unit 62. Below, a case where the state data of the compressor 12 is the rotation speed of the compressor rotor 12*a* will be described as an example.

The acquisition unit 61 also acquires a signal indicating an instruction to start the constant speed motor 11 from the outside. The acquisition unit 61 in the present embodiment receives, for example, a signal indicating a start instruction transmitted from an external input interface of the valve control device 60. The acquisition unit 61 transmits the acquired signal to the motor control unit 63.

Determination Unit

The determination unit 62 determines whether or not the compressor 12 is abnormal based on the state data of the compressor 12 acquired by the acquisition unit 61. The determination unit 62 receives the state data from the acquisition unit 61. The determination unit 62 compares the received state data of the compressor 12 with predetermined threshold values (first threshold value and second threshold value) stored in the determination unit 62 in advance.

Specifically, the determination unit 62 compares the state data with a first threshold value indicating a predetermined rated rotation speed. When the state data exceeds the first threshold value, the determination unit 62 determines that the compressor 12 is abnormal. That is, when the rotation speed of the compressor rotor 12*a* has increased above the rated rotation speed, the determination unit 62 determines that the compressor 12 is abnormal.

When the state data does not exceed the first threshold value, the determination unit 62 determines that the compressor 12 is normal. That is, when the rotation speed of the compressor rotor 12*a* is within the rated rotation speed, the determination unit 62 determines that the compressor 12 is normal. After completing the determination, the determination unit 62 transmits a signal indicating whether or not the compressor 12 is abnormal to the motor control unit 63 and the switching processing unit 64.

Further, the determination unit 62 determines whether or not the compressor rotor 12*a* of the compressor 12 is stopped based on the state data of the compressor 12 acquired by the acquisition unit 61. When the state data indicates that the compressor rotor 12*a* is not rotating, the determination unit 62 determines that the rotation of the compressor rotor 12*a* stops. In this case, the determination unit 62 transmits a signal indicating that the compressor rotor 12*a* stops to the switching processing unit 64.

Further, after transmitting the signal indicating that the compressor rotor 12*a* stops to the switching processing unit 64, the determination unit 62 determines whether or not the compressor 12 is in a transition state. Specifically, the determination unit 62 compares the state data with the second threshold value indicating a predetermined rotation speed.

The second threshold value in the present embodiment is smaller than the first threshold value. When the state data exceeds the second threshold value, the determination unit 62 determines that the compressor 12 is in a state of transition from startup to a rated operation. In this case, the determination unit 62 transmits a signal indicating that the compressor 12 is in the transition state to the switching processing unit 64.

Motor Control Unit

The motor control unit 63 stops the operation of the constant speed motor 11 when the determination unit 62 determines that the compressor 12 is abnormal. The motor control unit 63 receives a signal indicating whether or not the compressor 12 is abnormal from determination unit 62.

When the signal indicates that the compressor 12 is abnormal, the motor control unit 63 transmits a signal indicating a stop instruction to the constant speed motor 11. The constant speed motor 11 stops rotating when receiving a signal indicating a stop instruction from the motor control unit 63.

Further, the motor control unit 63 starts the constant speed motor 11 when receiving a signal indicating a start instruction from the acquisition unit 61. Specifically, the motor control unit 63 transmits the signal indicating the start instruction to the constant speed motor 11 and the switching processing unit 64 at the same time. The constant speed motor 11 starts rotating when receiving the signal indicating the start instruction from the motor control unit 63.

Switching Processing Unit

When the operation of the constant speed motor 11 is stopped, the switching processing unit 64 switches a fluid circulation state in the first regulating valve 22, the second regulating valve 32, the discharge valve 41, and the recirculation valve 51 between the fully open state that allows the circulation and the fully closed state that prevents the circulation. Open/closed states corresponding to the valve states of the valves (the first regulating valve 22, the second regulating valve 32, the discharge valve 41, and the recirculation valve 51) operated by the switching processing unit 64 will be described below with reference to FIG. 3.

The switching processing unit 64 receives a signal indicating whether or not the compressor 12 is abnormal from the determination unit 62. When the signal indicates that the compressor 12 is normal, the switching processing unit 64 determines that the compressor 12 is in a rated operation. After that, the switching processing unit 64 transmits a signal indicating a "valve state during a rated operation" to the first regulating valve 22, the second regulating valve 32, the discharge valve 41, and the recirculation valve 51 at the same time.

The first regulating valve 22 maintains the fully open state when receiving the signal indicating the valve state during the rated operation from the switching processing unit 64. The second regulating valve 32 maintains the fully open state when receiving the signal indicating the valve state during the rated operation from the switching processing unit 64.

The discharge valve 41 maintains the fully open state when receiving the signal indicating the valve state during the rated operation from the switching processing unit 64. The recirculation valve 51 maintains the fully closed state when receiving the signal indicating the valve state during the rated operation from the switching processing unit 64.

When the signal received from the determination unit 62 indicates that the compressor 12 is abnormal, the switching processing unit 64 transmits the signal indicating the "first valve state" to the first regulating valve 22, the second regulating valve 32, the discharge valve 41, and the recirculation valve 51 at the same time.

When receiving the signal indicating the first valve state from the switching processing unit 64, the first regulating valve 22 switches from the fully open state, which is the valve state during the rated operation, to the fully closed state. The second regulating valve 32 maintains the fully open state, which is the valve state during the rated operation, when receiving the signal indicating the first valve state from the switching processing unit 64.

The discharge valve 41 maintains the fully open state, which is the valve state during the rated operation, when receiving the signal indicating the first valve state from the switching processing unit 64. When receiving the signal indicating the first valve state from the switching processing unit 64, the recirculation valve 51 switches from the fully closed state, which is the valve state during the rated operation, to the fully open state.

Further, when the signal received from the determination unit 62 indicates that the compressor rotor 12*a* is stopped, the switching processing unit 64 transmits the signal indicating the "second valve state" to the first regulating valve 22, the second regulating valve 32, the discharge valve 41, and the recirculation valve 51 at the same time.

The first regulating valve 22 maintains the fully closed state, which is the first valve state, when receiving the signal indicating the second valve state from the switching processing unit 64. The second regulating valve 32 switches from the fully open state, which is the first valve state, to the fully closed state, when receiving the signal indicating the second valve state from the switching processing unit 64.

When receiving the signal indicating the second valve state from the switching processing unit 64, the discharge valve 41 switches from the fully open state, which is the first valve state, to the fully closed state. The recirculation valve 51 maintains the fully open state, which is the first valve state, when the signal indicating the second valve state is received from the switching processing unit 64.

Further, when the signal received from the motor control unit 63 indicates an instruction to start, the switching processing unit 64 outputs a signal indicating a "third valve state" to the first regulating valve 22, the second regulating valve 32, the discharge valve 41, and the recirculation valve 51 at the same time.

The first regulating valve 22 maintains the fully closed state, which is the second valve state, when receiving the signal indicating the third valve state from the switching processing unit 64. The second regulating valve 32 switches from the fully closed state, which is the second valve state, to the fully open state when receiving the signal indicating the third valve state from the switching processing unit 64.

When receiving the signal indicating the third valve state from the switching processing unit 64, the discharge valve 41 switches from the fully closed state, which is the second valve state, to the fully open state, or maintains the fully closed state. The recirculation valve 51 maintains the fully open state, which is the second valve state, when receiving the signal indicating the third valve state from the switching processing unit 64.

Further, when the signal received from the determination unit 62 indicates that the compressor 12 is in the transition state, the switching processing unit 64 transmits a signal indicating a "fourth valve state" to the first regulating valve 22, the second regulating valve 32, the discharge valve 41, and the recirculation valve 51 at the same time.

The first regulating valve 22 switches from the fully closed state, which is the third valve state, to the fully closed state when a signal indicating the fourth valve state is received from the switching processing unit 64. The second regulating valve 32 maintains the fully open state, which is the third valve state, when receiving the signal indicating the fourth valve state from the switching processing unit 64.

In a case where the signal indicating the fourth valve state is received from the switching processing unit 64, the discharge valve 41 maintains the fully open state when the second valve state is the fully open state, and switches from the fully closed state to the fully open state when the second valve state is the fully closed state. When receiving the signal indicating the fourth valve state from the switching processing unit 64, the recirculation valve 51 switches from the fully open state, which is the third valve state, so as to decrease the flow rate.

Operation of Valve Control Device

Figure 4:
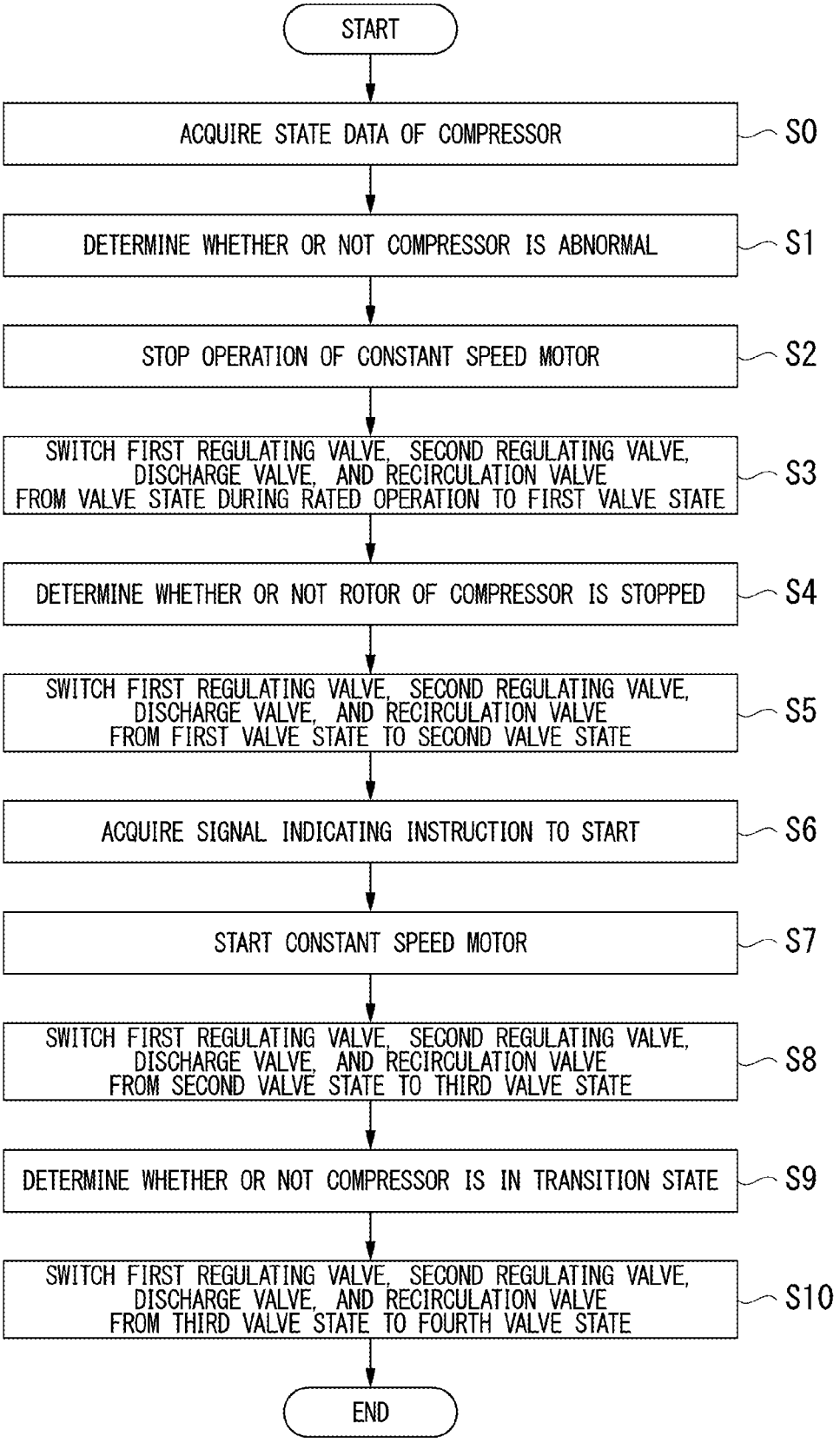
FIG. 4 is a diagram showing valve states of various valves switched by a switching processing unit of the valve control device according to the embodiment of the present disclosure.

Next, an operation of the valve control device 60 will be described with reference to FIG. 4.

The acquisition unit 61 acquires the state data of the compressor 12 (Step S0). Next, based on the state data acquired by the acquisition unit 61, the determination unit 62 determines whether or not the compressor 12 is abnormal (Step S1). Next, when the acquisition unit 61 determines that the compressor 12 is abnormal, the motor control unit 63 stops the operation of the constant speed motor 11 (Step S2).

Next, when the operation of the constant speed motor 11 is stopped by the motor control unit 63, the switching processing unit 64 switches the first regulating valve 22, the second regulating valve 32, the discharge valve 41, and the recirculation valve 51 from valve states during the rated operation to the first valve state (Step S3).

Next, based on the state data acquired by the acquisition unit 61, the determination unit 62 determines whether or not the compressor rotor 12*a* is stopped (Step S4). Next, when the determination unit 62 determines that the compressor rotor 12*a* is stopped, the switching processing unit 64 switches the first regulating valve 22, the second regulating valve 32, the discharge valve 41, and the recirculation valve 51 from the first valve state to the second valve state (Step S5).

Next, the acquisition unit 61 acquires the signal indicating an instruction to start the constant speed motor 11 from the outside, and transmits the signal to the motor control unit 63 (Step S6). Next, the motor control unit 63 starts the operation of the constant speed motor 11 based on the signal indicating the start instruction received from the acquisition unit 61 (Step S7).

Next, when the operation of the constant speed motor 11 is started by the motor control unit 63, the switching processing unit 64 switches the first regulating valve 22, the second regulating valve 32, the discharge valve 41, and the recirculation valve 51 from the second valve state to the third valve state (Step S8).

Next, the determination unit 62 determines whether or not the compressor 12 is in the transition state (Step S9). Next, when the determination unit 62 determines that the compressor 12 is in the transition state, the switching processing unit 64 switches the first regulating valve 22, the second regulating valve 32, the discharge valve 41, and the recirculation valve 51 from the third valve state to the fourth valve state (Step S10).

Operation Method of Compression System

Figure 5:
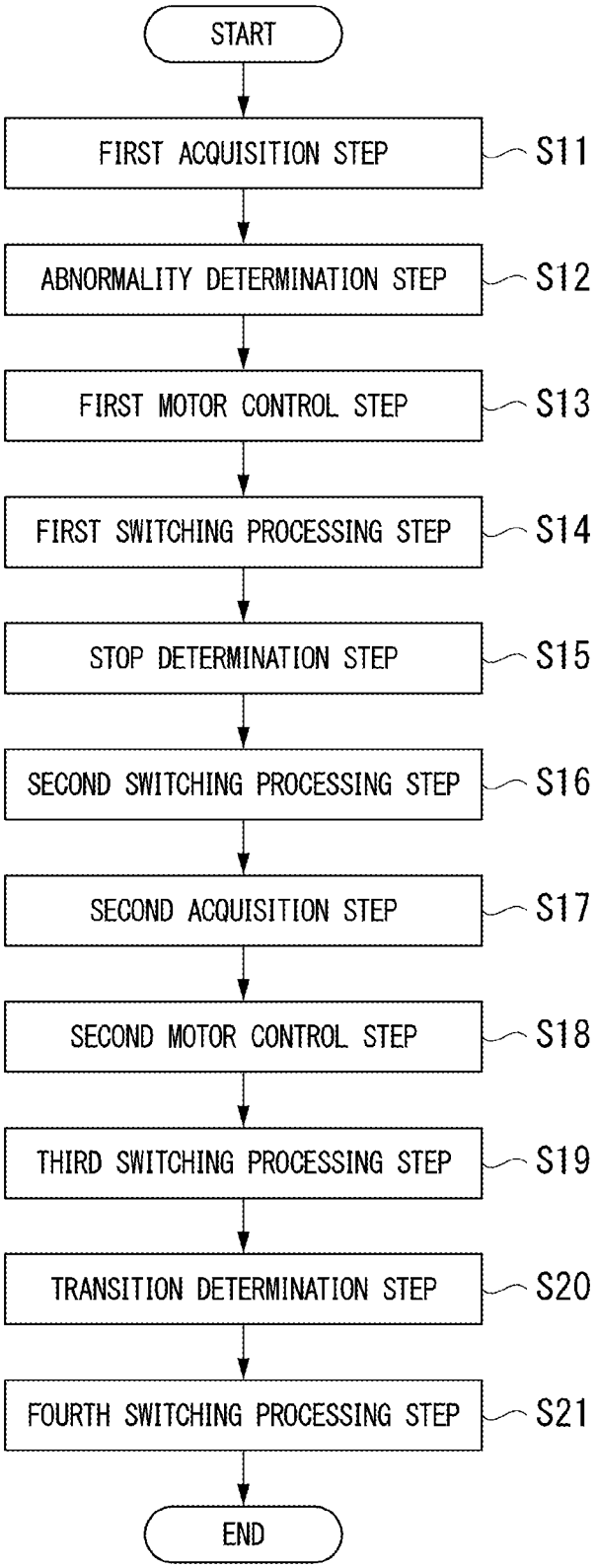
FIG. 5 is a flow chart showing a method of operating a compression system according to the embodiment of the present disclosure.

Next, a method of operating the compression system 1 will be described with reference to FIG. 5. The operation method includes a first acquisition step S11, an abnormality determination step S12, a first motor control step S13 (motor control step), a first switching processing step S14 (switching processing step), a stop determination step S15, a second switching processing step S16, a second acquisition step S17, a second motor control step S18, a third switching processing step S19, a transition determination step S20, and a fourth switching processing step S21.

First Acquisition Step

The first acquisition step S11 is a step of acquiring state data of the compressor 12. In the first acquisition step S11, the acquisition unit 61 acquires the state data of the compressor 12 measured by the sensor provided in the compressor 12.

Abnormality Determination Step

The abnormality determination step S12 is a step of determining whether or not the compressor 12 is abnormal following the first acquisition step S11. In the abnormality determination step S12, the state data of the compressor 12 acquired in the first acquisition step S11 is compared with a predetermined threshold value stored in advance by the determination unit 62 to determine whether or not the compressor 12 is abnormal by the determination unit 62.

First Motor Control Step

The first motor control step S13 is a step of stopping the operation of the constant speed motor 11 following the abnormality determination step S12. In the first motor control step S13, the operation of the constant speed motor 11 is stopped by the motor control unit 63 when it is determined that the compressor 12 is abnormal in the abnormality determination step S12.

First Switching Processing Step

The first switching processing step S14 is a step of switching the first regulating valve 22, the second regulating valve 32, the discharge valve 41, and the recirculation valve 51 from the valve state during the rated operation to the first valve state, following the first motor control step S13. In the first switching processing step S14, when the operation of the constant speed motor 11 is stopped in the first motor control step S13, the switching processing unit 64 switches the first regulating valve 22, the second regulating valve 32, the discharge valve 41, and the recirculation valve 51 from the valve state during the rated operation to the first valve state.

Stop Determination Step

The stop determination step S15 is a step of determining whether or not the compressor rotor 12*a* is stopped following the first switching processing step S14. In the stop determination step S15, the determination unit 62 determines whether or not the compressor rotor 12*a* is stopped based on the state data acquired by the acquisition unit 61.

Second Switching Processing Step

The second switching processing step S16 is a step of switching the first regulating valve 22, the second regulating valve 32, the discharge valve 41, and the recirculation valve 51 from the first valve state to the second valve state following the stop determination step S15. In the second switching processing step S16, when it is determined that the compressor rotor 12*a* is stopped in the stop determination step S15, the switching processing unit 64 switches the first regulating valve 22, the second regulating valve 32, the discharge valve 41, and the recirculation valve 51 from the first valve state to the second valve state.

Second Acquisition Step

The second acquisition step S17 is a step of acquiring from the outside a signal indicating an instruction to start the constant speed motor 11, following the second switching processing step S16. In the second acquisition step S17, the acquisition unit 61 acquires the signal indicating the instruction to start the constant speed motor 11 from the outside.

Second Motor Control Step

The second motor control step S18 is a step of starting the operation of the constant speed motor 11, following the second acquisition step S17. In the second motor control step S18, the operation of the constant speed motor 11 is started by the motor control unit 63 based on the signal indicating the instruction to start the constant speed motor 11 acquired in the second acquisition step S17.

Third Switching Processing Step

The third switching processing step S19 is a step of switching the first regulating valve 22, the second regulating valve 32, the discharge valve 41, and the recirculation valve 51 from the second valve state to the third valve state, following the second motor control step S18. In the third switching processing step S19, when the constant speed motor 11 is started in the second motor control step S18, the switching processing unit 64 switches the first regulating valve 22, the second regulating valve 32, the discharge valve 41, and the recirculation valve 51 from the second valve state to the third valve state.

Transition Determination Step

The transition determination step S20 is a step of determining whether or not the compressor 12 is in the transition state following the third switching processing step S19. In the transition determination step S20, the determination unit 62 determines whether or not the compressor 12 is in the transition state based on the state data acquired by the acquisition unit 61.

Fourth Switching Processing Step

The fourth switching processing step S21 is a step of switching the first regulating valve 22, the second regulating valve 32, the discharge valve 41, and the recirculation valve 51 from the third valve state to the fourth valve state, following the transition determination step S20. In the second fourth switching processing step, when it is determined that the compressor 12 is in the transition state in the transition determination step S20, the switching processing unit 64 switches the first regulating valve 22, the second regulating valve 32, the discharge valve 41, and the recirculation valve 51 from the third valve state to the fourth valve state.

The compression system 1 is operated through the series of steps described above.

Action Effect

In the compression system 1 according to the above embodiment, when the determination unit 62 in the valve control device 60 determines that the compressor 12 is abnormal, the switching processing unit 64 in the valve control device 60 performs transitions of the first regulating valve 22, the second regulating valve 32, the discharge valve 41, and the recirculation valve 51 from the valve state during the rated operation to the first valve state.

As a result, when an abnormality occurs in the compressor 12 and the operation of the compressor 12 is stopped (when a trip occurs), in the first gas and the second gas constituting the synthesis gas, only the second gas having a small molecular weight is supplied to compressor 12 through the second line 31 and the first line 21.

In the present embodiment, when the compressor 12 is stopped, the compressor rotor 12*a* does not stop at the same time as the operation of the compressor is stopped, but goes to a stopped state while reducing the rotation speed. Therefore, the second gas continues to be sucked into the compressor 12 with this rotation of the compressor rotor 12*a*.

Therefore, a proportion of the second gas in the compressor 12 can be made higher than that of the first gas. That is, the molecular weight of the synthesis gas present in the compressor 12 can be reduced. Therefore, the molecular weight of the gas present in the compressor 12 when the operation of the compressor 12 is stopped decreases. Therefore, a torque required to restart the compressor 12 can be reduced. As a result, the constant speed motor 11 can be miniaturized.

Further, in the compression system 1 according to the above embodiment, the first check valve 23 is arranged in the first line 21, the second check valve 33 is arranged in the second line 31, and the third check valve 42 is arranged in the discharge line 40. As a result, for example, even when the first regulating valve 22, the second regulating valve 32, and the discharge valve 41 are fully opened in a state where the compressor 12 is stopped, gas can be prevented from flowing reversely.

Further, in the compression system 1 according to the above embodiment, when the determination unit 62 in the valve control device 60 determines that the rotation of the compressor rotor 12*a* of the compressor 12 is stopped, the switching processing unit 64 in the valve control device 60 performs transitions of the first regulating valve 22, the second regulating valve 32, the discharge valve 41, and the recirculation valve 51 from the first valve state to the second valve state.

Thereby, the second gas is not newly introduced into the compressor 12 through the first line 21 and the second line 31. Further, gases such as the first gas and the second gas are not discharged from the compressor 12 through the discharge line 40 toward other systems. Therefore, the proportion of the second gas in the compressor 12 can be kept constant.

Further, in the compression system 1 according to the above-described embodiment, when starting the compressor 12, the constant speed motor 11 is started and the switching processing unit 64 in the valve control device 60 performs transitions of the first regulating valve 22, the second regulating valve 32, the discharge valve 41, and the recirculation valve 51 from the second valve state to the third valve state and then to the fourth valve state in this order.

As a result, compared to the configuration of the compression system 1 that starts supplying the synthesis gas to the compressor 12 at restart, in a state where the molecular weight of the gas in the compressor 12 is kept low, the transition to the valve state during the rated operation can be performed. Therefore, the torque required for restarting the compressor 12 can be further reduced.

Moreover, in the chemical plant 100 according to the above embodiment, the first gas supply source 20 generates the first gas, and the generated first gas is supplied to the compressor 12 through the first line 21. Then, the second gas supply source 30 generates the second gas, and this generated second gas is supplied to the first line 21 through the second line 31.

As a result, for example, compared to the configuration of the chemical plant 100 that includes a device that supplies the synthesis gas in which the first gas and the second gas are synthesized in advance to the compressor 12, when an abnormality occurs in the compressor 12 and the operation of the compressor 12 is stopped, only the second gas can be supplied to the compressor 12.

Other Embodiments

As described above, the embodiment of the present disclosure has been described in detail with reference to the drawings, but the specific configuration is not limited to the configuration of the embodiment, additions, omissions, substitutions, and other changes of the configuration are possible within a scope which does not depart from the gist of the present disclosure.

Figure 6:
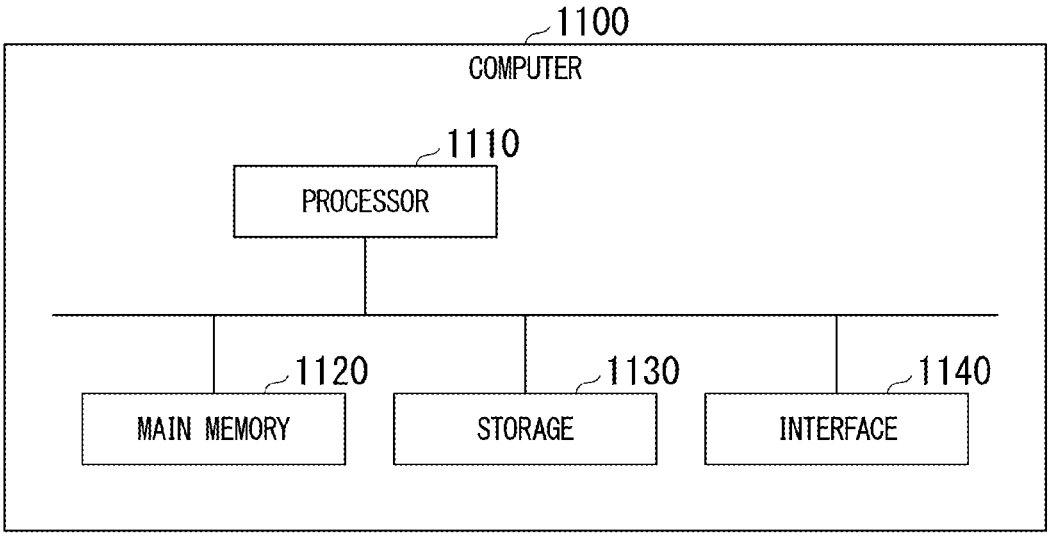
FIG. 6 is a hardware configuration diagram showing the configuration of a computer according to the embodiment of the present disclosure.

FIG. 6 is a hardware configuration diagram showing a configuration of a computer 1100 according to the present embodiment.

The computer 1100 includes a processor 1110, a main memory 1120, a storage 1130, and an interface 1140.

The valve control device 60 described above is implemented in the computer 1100. The operation of each processing unit described above is stored in the storage 1130 in the form of a program. The processor 1110 reads a program from the storage 1130, develops the program in the main memory 1120, and executes the above processing according to the program. In addition, the processor 1110 secures storage areas corresponding to the storage units described above in the main memory 1120 according to the program.

The program may be for realizing part of the functions that the computer 1100 is caused to exhibit. For example, the program may function in combination with another program already stored in the storage 1130 or in combination with another program implemented in another device.

Moreover, the computer 1100 may include a custom Large Scale Integrated Circuit (LSI) such as a Programmable Logic Device (PLD) in addition to or instead of the above configuration. A Programmable Array Logic (PAL), a Generic Array Logic (GAL), a Complex Programmable Logic Device (CPLD), and a Field Programmable Gate Array (FPGA) are exemplary examples of the PLD. In this case, some or all of the functions realized by the processor 1110 may be realized by the integrated circuit.

A magnetic disk, a magneto-optical disk, a semiconductor memory, and the like are exemplary examples of the storage 1130. The storage 1130 may be an internal medium directly connected to a bus of the computer 1100, or an external medium connected to the computer 1100 via the interface 1140 or communication line.

Further, when this program is distributed to the computer 1100 via a communication line, the computer 1100 receiving the distribution may develop the program in the main memory 1120 and execute the above processing. In the above embodiment, the storage 1130 is a non-transitory tangible storage medium.

Moreover, the program may be for realizing some of the functions described above. Furthermore, the program may be a so-called difference file (difference program) that realizes the above-described functions in combination with another program already stored in the storage 1130.

Moreover, the valve control device 60 described in the above embodiment may further have a storage unit in which the first threshold value and the second threshold value are stored. In this case, the determination unit 62 may not store the first threshold value and the second threshold value, but may refer to the first threshold value stored in the storage unit to determine whether or not the compressor 12 is abnormal and may refer to the second threshold value stored in the storage unit to determine whether or not the compressor 12 is in the transition state.

Further, in the above-described embodiment, the configuration in which nitrogen ($N_2$) is adopted as the first gas and hydrogen ($H_2$) is adopted as the second gas is an exemplary example, but the present invention is not limited to this configuration. A configuration may be adopted in which methane ($CH_4$) is adopted as the first gas and hydrogen is adopted as the second gas. In this case, the compressor 12 may be, for example, a compressor 12 for compressing combustion gas used in a hydrogen co-firing gas turbine in the chemical plant 100. It is sufficient that the first molecular weight of the first gas is greater than the second molecular weight of the second gas. Furthermore, the synthesis gas may contain at least the first gas and the second gas, and may further contain other gases in addition to the first gas and the second gas.

Further, in the above embodiment, the configuration is described in which the second line 31 is connected to the first line 21, and the second gas flowing in the second line 31 joins the first gas flowing in the first line 21 in the first line 21, but the present disclosure is not limited to this configuration. For example, the compression system 1 may further include a tank arranged in the middle of the first line 21 and connected to the second line 31 to internally synthesize the first gas and the second gas. In this case, the tank is arranged between the first check valve 23 and the recirculation line 50 in the first line 21 and the second line 31 is not directly connected to the first line 21.

In the above-described embodiment, the determination unit 62 determines whether or not the compressor 12 is abnormal, but, the present disclosure is not limited to this configuration, and whether or not the compressor 12 is abnormal may be determined visually by an operator who operates the compression system 1.

Additional Note

The compression system, the chemical plant, and the method of operating a compression system according to the embodiments are grasped, for example, as follows.

(1) According to a first aspect, there is provided a compression system 1 including: a constant speed motor 11; a compressor 12 that is configured to rotate by the constant speed motor 11 to compress a synthesis gas including at least a first gas and a second gas to produce a compressed gas; a first line 21 that connected to the compressor 12 to supply the first gas constituting a part of the synthesis gas to the compressor 12; a second line 31 that is connected to the first line 21 to supply the second gas constituting a part of the synthesis gas to the first line 21; a discharge line 40 that is connected to the compressor 12 to circulate the compressed gas discharged from the compressor 12; a recirculation line 50 that connects the discharge line 40 and the first line 21 to recirculate a part of the compressed gas from the discharge line 40 to the first line 21; a first regulating valve 22 configured to adjust a flow rate of the first gas in the first line 21; a second regulating valve 32 configured to adjust a flow rate of the second gas in the second line 31; a discharge valve 41 configured to adjust a flow rate of the compressed gas in the discharge line 40; a recirculation valve 51 configured to adjust a flow rate of the compressed gas in the recirculation line 50; and a valve control device 60 configured to perform switching between the first regulating valve 22, the second regulating valve 32, the discharge valve 41, and the recirculation valve 51 based on an operation condition of the compressor 12, in which the valve control device 60 includes a determination unit 62 that determines whether or not the compressor 12 is abnormal, a motor control unit 63 that stops an operation of the constant speed motor 11 when the determination unit 62 determines that the compressor 12 is abnormal, and a switching processing unit 64 configured to switch a fluid circulation state in the first regulating valve 22, the second regulating valve 32, the discharge valve 41, and the recirculation valve 51 between a fully open state that allows circulation and a fully closed state that prevents circulation when the operation of the constant speed motor 11 is stopped, the first gas has a first molecular weight, the second gas has a second molecular weight smaller than the first molecular weight, the switching processing unit 64 switches the first regulating valve 22, the second regulating valve 32, the discharge valve 41, and the recirculation valve 51 from a valve state during the rated operation of the compressor 12 to a first valve state when the operation of the constant speed motor 11 is stopped, and in the first valve state, the first regulating valve 22 is switched from the fully open state, which is the valve state during the rated operation, to the fully closed state, the second regulating valve 32 and the discharge valve 41 are maintained in the fully open state, which is the valve state during the rated operation, and the recirculation valve 51 is switched from the fully closed state, which is the valve state during the rated operation, to the fully open state.

As a result, when an abnormality occurs in the compressor 12 and the operation of the compressor 12 is stopped, in the first gas and the second gas constituting the synthesis gas, only the second gas having a small molecular weight is supplied to compressor 12 through the second line 31 and the first line 21.

(2) In the compression system 1 according to a second aspect, the compression system 1 of (1) may further include: a first check valve 23 configured to prevent reverse flow of the first gas from the compressor 12 to the first line 21; a second check valve 33 configured to prevent reverse flow of the second gas from the compressor 12 to the second line 31; and a third check valve 42 configured to prevent the compressed gas in the discharge line 40 from flowing reversely to the compressor 12.

As a result, for example, even when the first regulating valve 22, the second regulating valve 32, and the discharge valve 41 are fully opened in a state where the compressor 12 is stopped, gas can be prevented from flowing backward.

(3) In the compression system 1 according to a third aspect, in the compression system 1 of (1) or (2), in which when a rotation of a rotor of the compressor 12 stops after the operation of the constant speed motor 11 stops, the switching processing unit 64 may switch the first regulating valve 22, the second regulating valve 32, the discharge valve 41, and the recirculation valve 51 from the first valve state to a second valve state, and in the second valve state, the first regulating valve 22 and the second regulating valve 32 may be maintained in the fully closed state, the discharge valve 41 may be switched from the fully open state to the fully closed state, and the recirculation valve 51 may be maintained in the fully open state.

As a result, the second gas is not newly introduced into the compressor 12 through the first line 21 and the second line 31, and gases such as the first gas and the second gas are not discharged from the compressor 12 through the discharge line 40 toward other systems.

(4) In the compression system 1 according to a fourth aspect, in the compression system 1 of (3), in which when the compressor 12 is operated, the switching processing unit 64 may start the constant speed motor 11, and switch the first regulating valve 22, the second regulating valve 32, the discharge valve 41, and the recirculation valve 51 from the second valve state to a third valve state and a fourth valve state in this order, in the third valve state, the first regulating valve 22 may be maintained in the fully closed state, the second regulating valve 32 may be switched from the fully closed state to the fully open state, and the recirculation valve 51 may be maintained in the fully open state, and in the fourth valve state, the first regulating valve 22 may be switched from the fully closed state to the fully open state, the second regulating valve 32 may be maintained in the fully open state, the discharge valve 41 may be switched from the fully closed state to the fully open state, and the recirculation valve 51 may be switched to reduce a flow rate from the fully open state.

As a result, in a state where the molecular weight of the gas in the compressor 12 is kept low, the transition to the valve state during the rated operation can be performed.

(5) According to a fifth aspect, there is provided a chemical plant 100 including: the compression system 1 according to any one of (1) to (4); a first gas supply source 20 configured to produce the first gas and supplies the first gas to the first line 21; and a second gas supply source 30 configured to produce the second gas and supplies the second gas to the second line 31.

As a result, compared to the configuration of the chemical plant 100 that includes a device that supplies the synthesis gas in which the first gas and the second gas are synthesized in advance to the compressor 12, when an abnormality occurs in the compressor 12 and the operation of the compressor 12 is stopped, only the second gas can be supplied to the compressor 12.

(6) According to a sixth aspect, there is provided a method of operating a compression system 1 including a constant speed motor 11, a compressor 12 that is configured to rotate by the constant speed motor 11 to compress a synthesis gas including at least a first gas and a second gas to produce a compressed gas, a first line 21 that connected to the compressor 12 to supply the first gas constituting a part of the synthesis gas to the compressor 12, a second line 31 that is connected to the first line 21 to supply the second gas constituting a part of the synthesis gas to the first line 21, a discharge line 40 that is connected to the compressor 12 to circulate the compressed gas discharged from the compressor 12, a recirculation line 50 that connects the discharge line 40 and the first line 21 to recirculate a part of the compressed gas from the discharge line 40 to the first line 21, a first regulating valve 22 configured to adjust a flow rate of the first gas in the first line 21, a second regulating valve 32 configured to adjust a flow rate of the second gas in the second line 31, a discharge valve 41 configured to adjust a flow rate of the compressed gas in the discharge line 40, and a recirculation valve 51 configured to adjust a flow rate of the compressed gas in the recirculation line 50, the method including: an abnormality determination step S12 of determining whether or not the compressor 12 is abnormal; a motor control step of stopping an operation of the constant speed motor 11 when it is determined that the compressor 12 is abnormal; and a switching processing step of switching a fluid circulation state in the first regulating valve 22, the second regulating valve 32, the discharge valve 41, and the recirculation valve 51 between a fully open state that allows circulation and a fully closed state that prevents circulation when the operation of the constant speed motor 11 is stopped, in which the first gas has a first molecular weight, the second gas has a second molecular weight smaller than the first molecular weight, in the switching processing step, the first regulating valve 22, the second regulating valve 32, the discharge valve 41, and the recirculation valve 51 are switched from a valve state during a rated operation of the compressor 12 to a first valve state when the operation of the constant speed motor 11 is stopped, and in the first valve state, the first regulating valve 22 is switched from the fully open state, which is the valve state during the rated operation, to the fully closed state, the second regulating valve 32 and the discharge valve 41 are maintained in the fully open state, which is the valve state during the rated operation, and the recirculation valve 51 is switched from the fully closed state, which is the valve state during the rated operation, to the fully open state.

EXPLANATION OF REFERENCES

1 Compression system
10 Compression device
11 Constant speed motor
11*a* Output shaft
12 Compressor
12*a* Compressor rotor
12*b* Compressor casing
13 Speed increaser
20 First gas supply source
21 First line
22 First regulating valve
23 First check valve
30 Second gas supply source
31 Second line
32 Second regulating valve
33 Second check valve
40 Discharge line
41 Discharge valve
42 Third check valve
50 Recirculation line
51 Recirculation valve
60 Valve control device
61 Acquisition unit
62 Determination unit
63 Motor control unit
64 Switching processing unit
100 Chemical plant
1100 Computer
1110 Processor
1120 Main memory
1130 Storage
1140 Interface
Da Axial direction
Dar One side
Dal Other side
O Axis
S11 First acquisition step
S12 Abnormality determination step
S13 First motor control step
S14 First switching processing step
S15 Stop determination step
S16 Second switching processing step
S17 Second acquisition step
S18 Second motor control step
S19 Third switching processing step
S20 Transition determination step
S21 Fourth switching processing step

What is claimed is:

1. A compression system comprising:

a constant speed motor;

a compressor that is configured to rotate by the constant speed motor to compress a synthesis gas including at least a first gas and a second gas to produce a compressed gas;

a first line that connected to the compressor to supply the first gas constituting a part of the synthesis gas to the compressor;

a second line that is connected to the first line to supply the second gas constituting a part of the synthesis gas to the first line;

a discharge line that is connected to the compressor to circulate the compressed gas discharged from the compressor;

a recirculation line that connects the discharge line and the first line to recirculate a part of the compressed gas from the discharge line to the first line;

a first regulating valve configured to adjust a flow rate of the first gas in the first line;

a second regulating valve configured to adjust a flow rate of the second gas in the second line;

a discharge valve configured to adjust a flow rate of the compressed gas in the discharge line;

a recirculation valve configured to adjust a flow rate of the compressed gas in the recirculation line; and a valve control device configured to perform switching between the first regulating valve, the second regulating valve, the discharge valve, and the recirculation valve based on an operation condition of the compressor, wherein the valve control device includes a determination unit that determines whether or not the compressor is abnormal, a motor control unit that stops an operation of the constant speed motor when the determination unit determines that the compressor is abnormal, and a switching processing unit configured to switch a fluid circulation state in the first regulating valve, the second regulating valve, the discharge valve, and the recirculation valve between a fully open state that allows circulation and a fully closed state that prevents circulation when the operation of the constant speed motor is stopped, the first gas has a first molecular weight, the second gas has a second molecular weight smaller than the first molecular weight, the switching processing unit switches the first regulating valve, the second regulating valve, the discharge valve, and the recirculation valve from a valve state during a rated operation of the compressor to a first valve state when the operation of the constant speed motor is stopped, and in the first valve state, the first regulating valve is switched from the fully open state, which is the valve state during the rated operation, to the fully closed state, the second regulating valve and the discharge valve are maintained in the fully open state, which is the valve state during the rated operation, and the recirculation valve is switched from the fully closed state, which is the valve state during the rated operation, to the fully open state.

2. The compression system according to claim 1, further comprising:

a first check valve configured to prevent reverse flow of the first gas from the compressor to the first line;

a second check valve configured to prevent reverse flow of the second gas from the compressor to the second line; and a third check valve configured to prevent the compressed gas in the discharge line from flowing reversely to the compressor.

3. The compression system according to claim 1, wherein when a rotation of a rotor of the compressor stops after the operation of the constant speed motor stops, the switching processing unit switches the first regulating valve, the second regulating valve, the discharge valve, and the recirculation valve from the first valve state to a second valve state, and in the second valve state, the first regulating valve and the second regulating valve are maintained in the fully closed state, the discharge valve is switched from the fully open state to the fully closed state, and the recirculation valve is maintained in the fully open state.

4. The compression system according to claim 3, wherein when the compressor is operated, the switching processing unit starts the constant speed motor, and switches the first regulating valve, the second regulating valve, the discharge valve, and the recirculation valve from the second valve state to a third valve state and a fourth valve state in this order, in the third valve state, the first regulating valve is maintained in the fully closed state, the second regulating valve is switched from the fully closed state to the fully open state, and the recirculation valve is maintained in the fully open state, and in the fourth valve state, the first regulating valve is switched from the fully closed state to the fully open state, the second regulating valve is maintained in the fully open state, the discharge valve is switched from the fully closed state to the fully open state, and the recirculation valve is switched to reduce a flow rate from the fully open state.

5. A chemical plant comprising:

the compression system according to claim 1;

a first gas supply source configured to produce the first gas and supplies the first gas to the first line; and a second gas supply source configured to produce the second gas and supplies the second gas to the second line.

6. A method of operating a compression system including a constant speed motor, a compressor that is configured to rotate by the constant speed motor to compress a synthesis gas including at least a first gas and a second gas to produce a compressed gas, a first line that connected to the compressor to supply the first gas constituting a part of the synthesis gas to the compressor, a second line that is connected to the first line to supply the second gas constituting a part of the synthesis gas to the first line, a discharge line that is connected to the compressor to circulate the compressed gas discharged from the compressor, a recirculation line that connects the discharge line and the first line to recirculate a part of the compressed gas from the discharge line to the first line, a first regulating valve configured to adjust a flow rate of the first gas in the first line, a second regulating valve configured to adjust a flow rate of the second gas in the second line, a discharge valve configured to adjust a flow rate of the compressed gas in the discharge line, and a recirculation valve configured to adjust a flow rate of the compressed gas in the recirculation line, the method comprising:

an abnormality determination step of determining whether or not the compressor is abnormal;

a motor control step of stopping an operation of the constant speed motor when it is determined that the compressor is abnormal; and a switching processing step of switching a fluid circulation state in the first regulating valve, the second regulating valve, the discharge valve, and the recirculation valve between a fully open state that allows circulation and a fully closed state that prevents circulation when the operation of the constant speed motor is stopped, wherein the first gas has a first molecular weight, the second gas has a second molecular weight smaller than the first molecular weight, in the switching processing step, the first regulating valve, the second regulating valve, the discharge valve, and the recirculation valve are switched from a valve state during a rated operation of the compressor to a first valve state when the operation of the constant speed motor is stopped, and in the first valve state, the first regulating valve is switched from the fully open state, which is the valve state during the rated operation, to the fully closed state, the second regulating valve and the discharge valve are maintained in the fully open state, which is the valve state during the rated operation, and the recirculation valve is switched from the fully closed state, which is the valve state during the rated operation, to the fully open state.

* * * * *